United States Patent [19]

Solow

[11] Patent Number: 4,720,917

[45] Date of Patent: Jan. 26, 1988

[54] FLEXIBLE BLADE CONTOUR RAZOR

[76] Inventor: Terry S. Solow, 410 Playa Blvd., La Selva Beach, Calif. 95076

[21] Appl. No.: 947,352

[22] Filed: Dec. 29, 1986

Related U.S. Application Data

[63] Continuation-in-part of Ser. No. 775,827, Sep. 13, 1985, abandoned.

[51] Int. Cl.[4] ..... B26B 21/00

[52] U.S. Cl. ..... 30/49; 30/51; 30/346.5

[58] Field of Search ..... 30/32, 30, 47–51, 30/346.5, 346.58, 346.59, 329, 330

[56] References Cited

U.S. PATENT DOCUMENTS

| | | | |
|---|---|---|---|
| 1,742,330 | 1/1930 | Valet | 30/48 X |
| 2,001,155 | 5/1935 | Peters | 30/346.58 X |
| 2,041,778 | 5/1936 | Peters | 30/346.58 X |
| 4,459,744 | 7/1984 | Esnard | 30/346.5 |
| 4,501,066 | 2/1985 | Seeberras | 30/40 |

FOREIGN PATENT DOCUMENTS

| | | | |
|---|---|---|---|
| 52-15761 | 2/1977 | Japan | 30/50 |

*Primary Examiner*—Douglas D. Watts

[57] ABSTRACT

A flexible blade contour razor system is provided for shaving rounded or variably contoured shaving surfaces. The system includes a long, flexible blade carried by a plurality of blade-holder housings. Said blade-holder housings are connected by connecting means such as ribs, resilient foam, soft rubber or spring means to a handle.

Hinges generally connect each blade-holder housing to an adjacent blade-holder housing.

Said flexible blade contour razor system is adapted to flex during any single shaving stroke in order to conform to and closely shave any contoured surface of the body. Thus, a uniform, very wide, unbroken shaving swatch is achieved.

17 Claims, 14 Drawing Figures

FIG. 1B
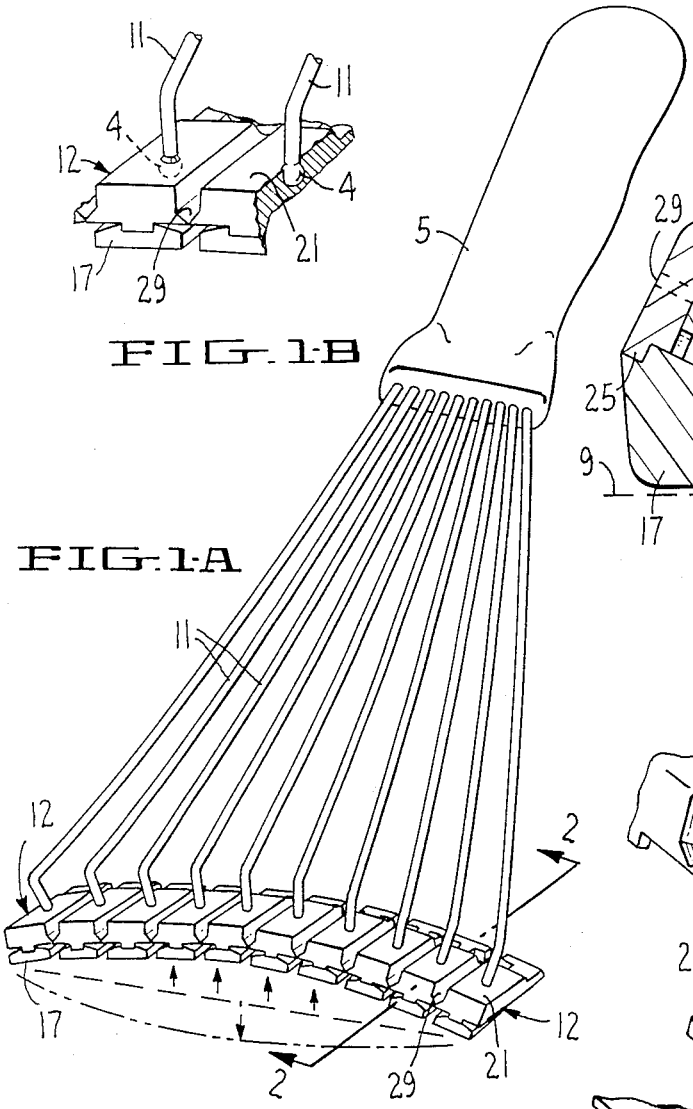
FIG. 1A
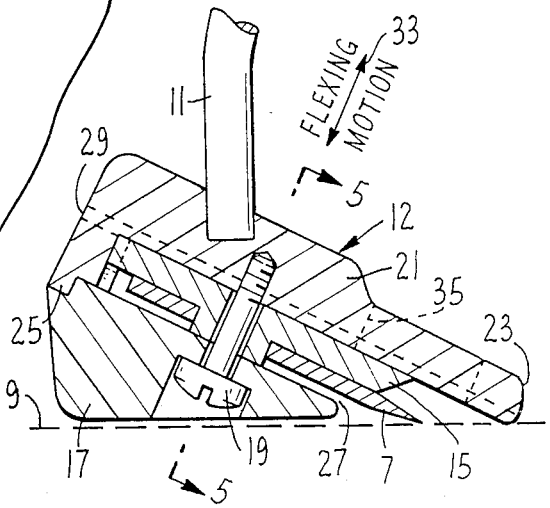
FIG. 2
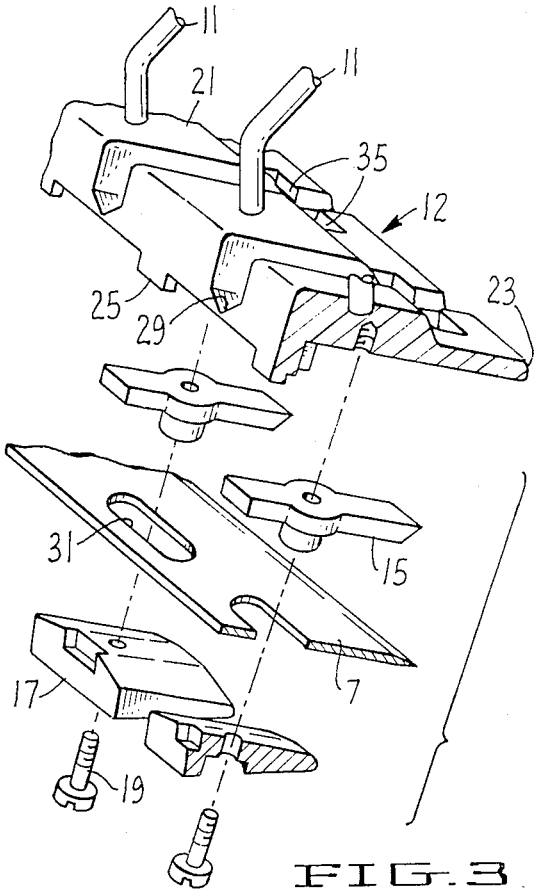
FIG. 3
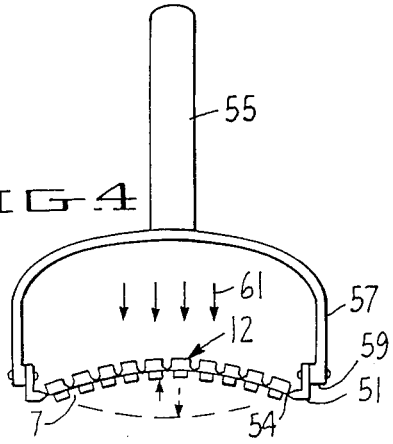
FIG. 4

FIG. 10.
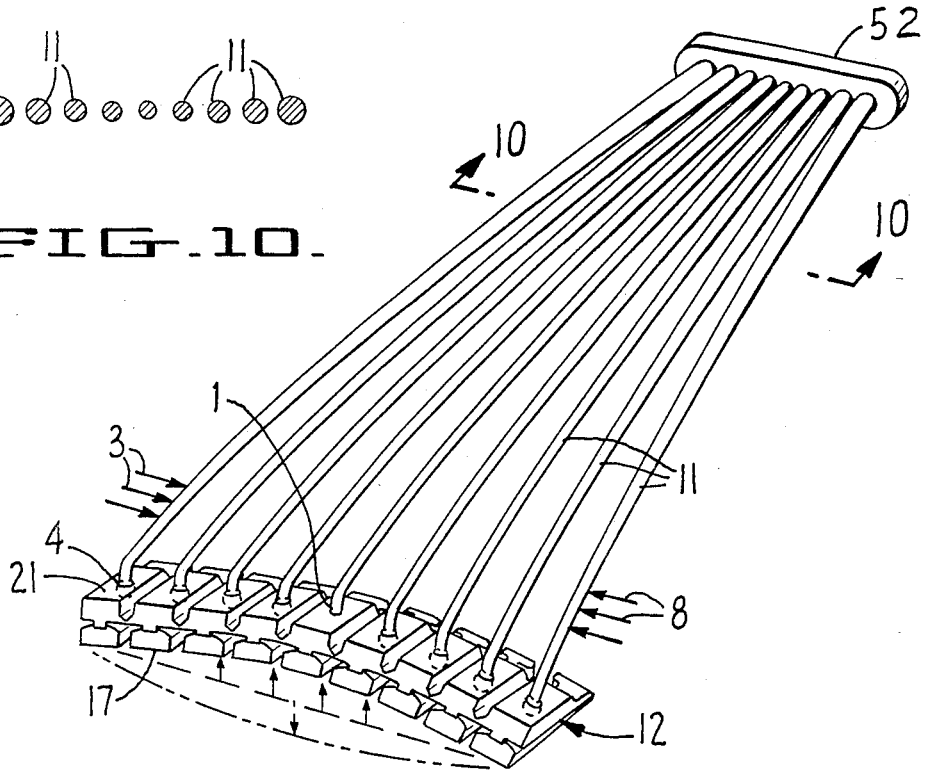
FIG. 9.
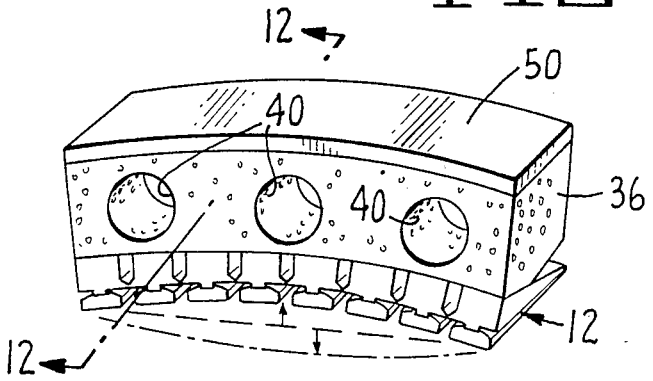
FIG. 11.
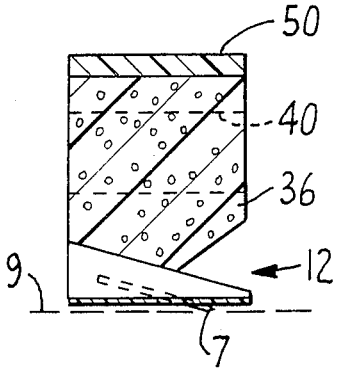
FIG. 12
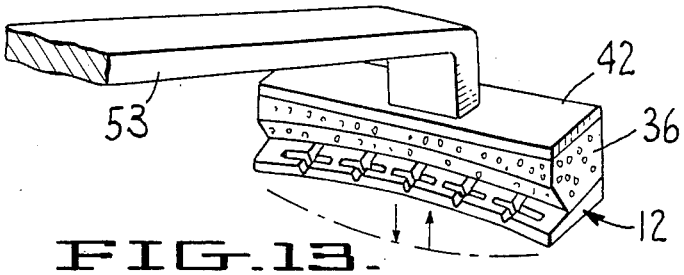
FIG. 13.

FLEXIBLE BLADE CONTOUR RAZOR

SUMMARY OF THE INVENTION

When trying to shave highly contoured surface areas of the body such as legs, arms, armpits, head or face, with a conventional rigid straight-edged razor, many strokes are required. This is because a straight-edged razor contacts a curved surface over a relatively short distance. Therefore, each razor stroke shaves only a narrow ribbon, regardless of the razor length. This makes shaving of large rounded or variably contoured body surfaces time-consuming and tedious.

The present invention relates to a razor system for shaving rounded or variably contoured shaving surfaces of the body. Whereas the prior art teaches the use of a relatively short blade with a rigid cutting surface, the present invention teaches the use of a relatively long blade that is flexible and bends easily to closely conform to any contoured surface being shaved, wherein a very wide, unbroken shaving swath is achieved. The user is, therefore, able to shave a much wider surface with each shaving stroke of said razor system than with any conventional straight-edged razor. This saves time in shaving because fewer strokes are required. Additionally, there is less likelihood of inadvertently missing ribbons of shaving surface because the much longer flexible blade shaves a far wider, unbroken, shaving swath per stroke.

The present invention teaches the use of a long, flexible blade that bends easily in order to closely conform to any shaving surface during shaving. Thus, in any single shaving stroke, the blade is able to effectively shave any curved shaving surface over virtually the entire cutting edge of said long blade.

A primary object of the present invention is to provide a razor system that uses a long flexible blade that may be drawn over any variably contoured shaving surface. Said razor system provides a uniform and complete shaving of said surface in a much shorter time than prior art.

Another object of the invention is to provide a razor system for shaving a rounded or variably contoured surface wherein a flexible blade is used and wherein all parts of the long cutting edge of said blade provide relatively uniform forces against the shaving surface.

A further object of the invention is to provide a razor system which is equally as capable of closely shaving convex, concave or flat surfaces in any single shaving stroke.

Various other features and advantages of the invention will be brought out in the balance of this specification.

BRIEF DESCRIPTION OF THE DRAWINGS

FIG. 1A is a perspective view of a razor system embodying this invention.

FIG. 1B is a perspective view, partially in section, of an alternative embodiment of that shown in FIG. 1A that employs ball-joint swivels.

FIG. 2 is a sectional view on the line 2—2 of FIG. 1.

FIG. 3 is an exploded view, partially in section, of the apparatus shown in FIG. 1A and FIG. 2.

FIG. 4 is an elevational view of an alternate embodiment of the present invention employing a chain of blade-holder housings.

FIG. 9 shows a perspective view of another embodiment of this invention wherein the ribs are also the razor handle.

FIG. 10 shows a sectional view on the line 10—10 of FIG. 9.

FIG. 11 shows a perspective view of a handheld embodiment of this invention employing flexible, resilient foam.

FIG. 12 shows a sectional view on the line 12—12 of FIG. 11.

FIG. 13 shows a perspective view of an alternative embodiment of this invention employing flexible, resilient foam, a rigid cover and a single handle.

DESCRIPTION OF THE PREFERRED EMBODIMENTS

Figure 8:
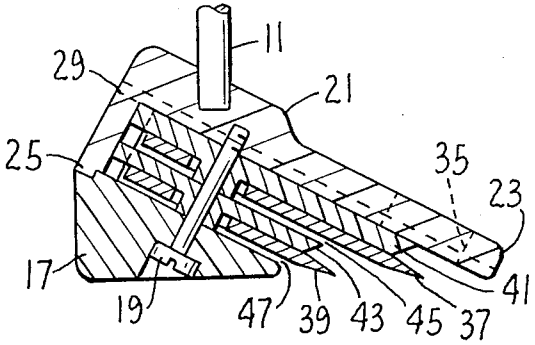
FIG. 8 shows an alternate blade arrangement in which a pair of flexible blades is mounted in tandem.

Referring to the drawings shown in FIGS. 1A, 2 and 3, the razor system of the present invention includes a handle 5 and ribs 11 connected to handle 5, each of the ribs 11 being flexible and resilient and extending generally in a radial direction from handle 5. Said ribs 11 may be tapered or have different cross-sectional areas similar to that shown in FIGS. 9 and 10. A plurality of blade-holder housings 12 is carried at the end of ribs 11, such that blade-holder housings 12 (and blade 7) are aligned in a direction, generally, perpendicular to the direction of shaving. Each of the blade-holder housings 12 is joined to at least one other blade-holder housing by plastic hinges 29, which allow said blade-holder housings 12 to flex relative to each other.

In use, the user simply grasps handle 5 and brings blade 7 into contact with the shaving surface 9. By pushing the handle 5 towards the shaving surface 9, ribs 11 bend and force blade-holder housings 12 to flex about v-joint plastic hinges 29 so as to closely conform to the contours of the shaving surface 9. The bending of ribs 11 also compensates for the changes in distances between handle 5 and blade-holder housings 12 during flexing of said housings 12 about their plastic hinges 29. Each v-joint hinge 29 extends along the side of each blade-holder housing base 21 and is a very thin, flexible strip of plastic as shown in FIGS. 1A, 1B, 3 and 5. It is noted that hinges 29 may be deleted where low cost is paramount and some extra torquing of blade 7 during shaving is acceptable.

As shown in FIGS. 1A, 2, 3, 5 and 6, a long, flexible blade 7 is employed that extends laterally across all blade-holder housings 12 and which can be easily coaxed into bending to whatever shape is dictated by the contour of shaving surface 9.

Pushing handle 5 pushes ribs 11 of FIG. 1A. Ribs 11 push the blade-holder housings 12 which, in turn, push the flexible razor blade 7 against the contoured shaving surface 9. Ribs 11 apply approximately equal forces to every part of the long cutting edge of blade 7. These approximately equal forces assure a uniformly close shave along the entire length of said blade for any contoured surface, during every stroke, regardless of the blade length.

Blade 7 is sandwiched between a blade support shoulder spacer 15 and a face guard blade cover 17. A small gap 27 is provided by the blade support shoulder spacer 15, in order to allow blade 7 to slide freely and easily lengthwise during flexing of said blade caused by contact with a curved shaving surface. When blade 7 flexes, as shown by arrows 33, its movement is limited by the constraints of screws 19 to movements within slotted mounting holes 31 of blade 7.

Shaving guard 23 is conventional and creates the "safety" razor feature common to virtually all modern razors, by keeping the shaving surface at a fixed distance from blade 7's sharp edge. Notches 25 keep face guards 17 in proper alignment with housing bases 21. Blade 7 flexes perpendicularly to its own plane. Screws 19 hold together the face guard blade covers 17, blade 7, blade-support shoulder spacers 15 and the blade-holder housing bases 21 of blade-holder housings 12.

As shown in FIG. 1A, all the blade-holder housings 12 flex about plastic hinges 29 as dictated by the contours of the shaving surface. As shown in phantom in FIG. 1A, the blade-holder housings 12 are free to form either a convex or concave arch. Additionally, as shown in FIG. 1A, blade-holder housings 12 are oriented in a concave fashion to shave a convex surface. Alternatively, by simply pressing the system against a concave surface, the center ribs will extend downwardly to the position shown in phantom in FIG. 1A so that the blade-holder housings 12 will be oriented in a convex fashion for shaving said concave surface. Alternatively, blade-holder housings 12 will form a straight line, as shown in phantom in FIG. 1A, when shaving a flat surface.

FIG. 1A shows the ends of ribs 11 attached in a fixed manner to blade-holder housings 12. During shaving of a contoured surface, the flexing and/or pitching motion of blade-holder housings 12 is accommodated by the bending of ribs 11.

Alternatively, FIG. 1B shows another embodiment of this invention wherein ball joint swivels 4 connect ribs 11 to blade-holder housings 12 of FIG. 1A (in a similar manner to that shown in FIG. 9). This allows the flexing and/or pitching motion of housings 12 during contour shaving to be achieved in a more efficient way. That is, less force is required by the user when pushing handle 5 towards the shaving surface 9. With less force required, the user is able to enjoy a more effortless shave.

If, in employing said embodiment containing said ball joint swivels 4, one should desire an automatic return-to-center position of blade-holder housings 12, one could employ features from both FIG. 1A and FIG. 1B. For example, one could have all ribs 11 connect to blade-holder housings 12 via ball joint swivels 4 except a center rib (similar to that shown in FIG. 9). Said center rib would be connected to blade-holder housings 12 in a fixed manner in order to provide a spring return-to-center position for blade-housings 12 when disengaged from the shaving surface 9.

FIG. 4 shows another embodiment of the invention. A plurality of blade-holder housings 12 is attached end to end by hinges to form a chain of blade-holder housings 12. Said chain of blade-holder housings 12 holds a continuous, long, flexible blade 7. Additionally, said chain is anchored at each end by plastic swivel brackets 51, via v-joint plastic hinges 54. The user grasps handle 55 and gently pushes blade-holder housings 12 against the surface to be shaved. Handle 55 is connected to swivel assembly 59 and 51 via arms 57 which are rib means in this embodiment. This embodiment works well for convex or flat shaving surfaces. To shave concave surfaces, such as the armpits, the user simply grasps handle 55 and with the forefinger pushes the center of blade-holder housings assembly 12 outward as denoted by arrows 61.

Figure 7:
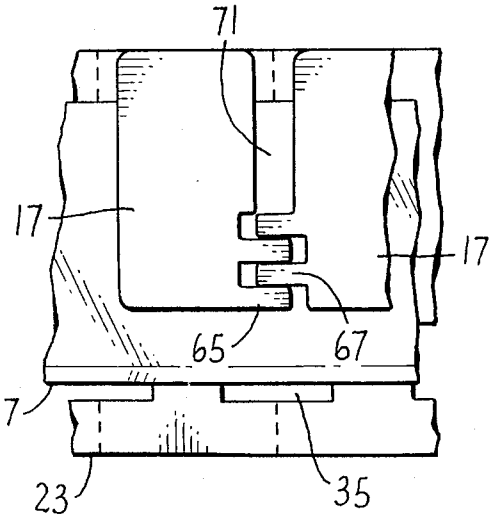
FIG. 7 shows an alternate face guard for use in the present invention.
Figure 5:
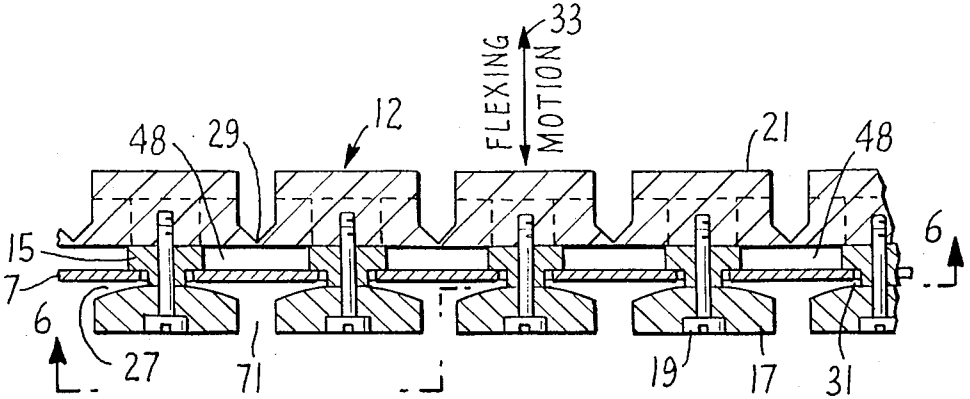
FIG. 5 is a sectional view on the line 5—5 of FIG. 2.
Figure 6:
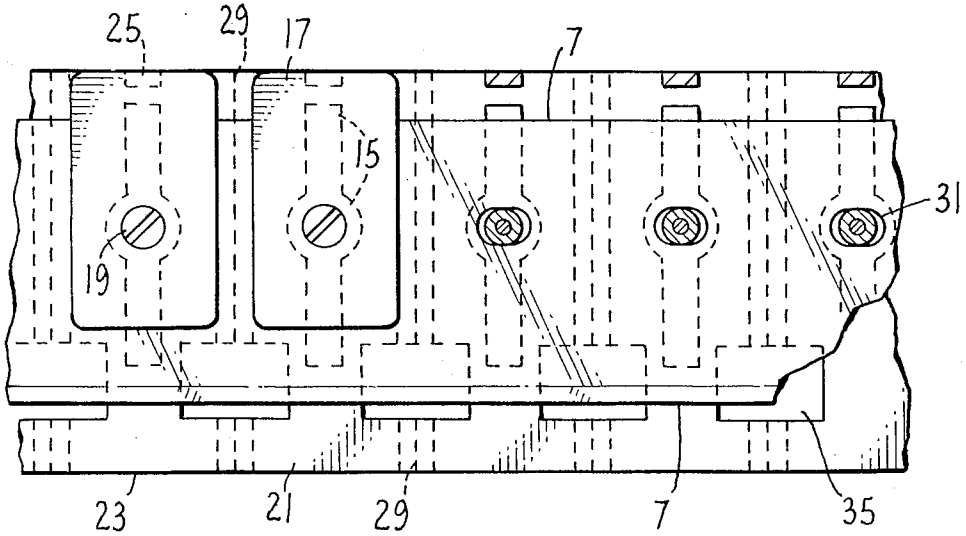
FIG. 6 is a sectional view on the line 6—6 of FIG. 5.

FIGS. 2, 6 and 7 show how shavings and lather may exit through slots 35, which are positioned just beneath the cutting edge of blade 7. FIGS. 5 and 6 show an additional exit route that said shavings and lather may take via the gaps between shoulder spacers 15, and is shown best in FIG. 5 as 48.

FIG. 7 shows face guards 17 of FIG. 6 with added tongue and groove appendages 65 and 67. These appendages are employed in this alternative embodiment where extra insurance is desired that the skin being shaved cannot be pinched as gap 71 contracts and expands during shaving of various contours.

FIG. 8 shows an alternate embodiment of this invention utilizing two blades 37 and 39 employed in tandem. To accommodate the two blades, two blade-support shoulder spacers 41 and 43 are employed. Gaps 45 and 47 are incorporated to allow easy sliding of said blades lengthwise while flexing. Screws 19 hold the entire assembly together.

Shavings and lather generated by blade 39 of FIG. 8 may exit the rear of the razor via the multiple gaps between blades 37 and 39.

FIG. 9 shows another embodiment of this invention wherein the ribs 11 are also the handle. Said ribs are connected in a fixed manner to rib-anchor 52 at the rear of the razor. The opposite ends of said ribs 11 are connected via ball-joint swivels 4 to blade-holder housings 12 at the front of the razor. Said ball-joint swivels 4 allow for easy tilting movements of said blade-holder housings 12 during shaving of contoured surfaces.

If it is desired to have blade-holder housings 12 automatically return to a center position, when disengaged from the shaving surface, a central rib 1 may be directly connected to its housing and thus act as a spring-return.

To shave with said razor, the user places rib anchor 52 at the base of the palm and grasps ribs 11 at arrows 8 and 3 between the thumb and middle finger. The user now can assist the flexing of blade-holder housings 12 by lightly squeezing said thumb and middle finger together during shaving. This gives the user a feeling of control over the flexing of said blade-holder housings 12 during shaving of convex surfaces. When shaving concave surfaces, the user must additionally place the forefinger on ribs 11 midway between said thumb and middle finger positions 8 and 3 near point 1. By pressing said forefinger lightly against said ribs near said point 1, the user can push the central section of blade-holder housings 12 outward as shown in phantom in FIG. 9. This allows for easy shaving of concave or flat surfaces.

FIG. 10 shows a cross-sectional view on the line 10—10 of FIG. 9. The outer ribs may be made of a larger diameter than the inner ribs.

FIGS. 11 and 12 show another embodiment of this invention that is a handheld razor version. Blade-holder housings 12 are similar to the blade-holder housings 12 shown in FIG. 9. Polyurethane foam 36 (or soft rubber) is attached to housings 12 and a flexible cover 50 is attached to the top of said foam 36. The user simply cups said cover 50 in the palm of the hand and proceeds to shave. Said handheld razor may also be held in an alternate manner using holes 40. The fingertips are inserted into holes 40 and the user proceeds to shave, using said fingertips to flex blade-holder housings 12 in order that they may conform to any contoured shaving surface.

FIG. 13 shows another embodiment of this invention. This embodiment is similar to that shown in FIG. 11 except a rigid cover 42 of FIG. 13 replaces flexible cover 50 of FIG. 11. Also, a conventional handle 53 is added to FIG. 13. The user simply grasps handle 53 of FIG. 13 and shaves by bringing flexible blade-holder housings 12 into contact with the shaving surface. Polyurethane foam 36 acts as a springy, resilient material that enables flexible blade-holder housings 12 to conform to a variably contoured shaving surface.

Alternate embodiments using one row or multiple rows of individual, coiled springs may be employed as a substitute for the polyurethane foam 36, if desired.

It is to be understood that the present invention is by no means limited to the particular construction herein disclosed and/or shown in the drawings, but also comprises any modifications or equivalents within the scope of the disclosure.

What is claimed is:

1. A flexible, contour-following razor system for shaving variably contoured shaving surfaces, comprising:

handle means, and connecting means carried by said handle means, and a plurality of blade-holder housings carried by said connecting means, and one continuous, flexible blade that flexes during shaving in a direction perpendicular to the plane of said blade and is carried by said plurality of blade-holder housings.

2. The system of claim 1 wherein said connecting means are ribs means.

3. The system of claim 1 wherein said connecting means are resilient springs means.

4. The system of claim 1 wherein said connecting means is a resilient, soft, rubbery material.

5. The system of claim 4 wherein said resilient, soft, rubbery material is polyurethane foam.

6. The system of claim 1 wherein said plurality of blade-holder housings is aligned in a direction perpendicular to the direction of shaving.

7. The system of claim 1 wherein each blade-holder housing of said plurality of blade-holder housings is connected to at least one of the other blade-holder housings by hinge means.

8. The system of claim 7 wherein said hinge means extends along the side of a blade-holder housing and consists of a thin, flexible strip that is attached to an adjacent blade-holder housing.

9. The system of claim 2 wherein said rib means comprises a plurality of flexible, resilient rods, such that each of said rods is attached to at least one of said blade-holder housings.

10. The system of claim 9 wherein each of said rods is attached to at least one of said blade-holder housings by swivel means.

11. The system of claim 2 wherein said rib means comprises a pair of arms, wherein the ends of said arms are attached to the ends of said plurality of blade-holder housings.

12. The system of claim 11 wherein the ends of said arms are attached to the ends of said plurality of blade-holder housings by swivel means.

13. The system of claim 1 wherein said continuous flexible blade comprises a blade with slotted mounting holes formed therein, along with blade-mounting means which allows said blade to flex within predetermined limits.

14. The system of claim 1 wherein said continuous flexible blade comprises a pair of blades mounted in tandem in said blade-holder housings.

15. The system of claim 1 wherein said system comprises a handheld, flexible group of blade-holder housings, with means for grasping said group of blade-holder housings.

16. The system of claim 2 wherein said rib means and said handle means are combined into handheld rib means.

17. The system of chain 16 wherein said handheld rib means may be flexed manually.

* * * * *